US005527027A

United States Patent [19]

Flade et al.

[11] Patent Number: 5,527,027

[45] Date of Patent: Jun. 18, 1996

[54] DEVICE AND METHOD FOR SEPARATING AND ALIGNING SHEETS IN A SHEET FEEDER OF A PRINTING MACHINE

[75] Inventors: Gregor Flade, Meckesheim; Karl-Hermann Miltner, Dossenheim, both of Germany

[73] Assignee: Heidelberger Druckmaschinen AG, Heidelberg, Germany

[21] Appl. No.: 158,687

[22] Filed: Nov. 26, 1993

[30] Foreign Application Priority Data

Nov. 26, 1992 [DE] Germany ..... 42 39 732.4

[51] Int. Cl.[6] ..... B65H 3/12

[52] U.S. Cl. ..... 271/94; 271/228

[58] Field of Search ..... 271/11–13, 15, 271/34, 91, 92, 94, 95, 107, 227, 228, 236, 270, 275, 276, 258–261, 265, 239, 253, 254

[56] References Cited

U.S. PATENT DOCUMENTS

| | | | |
|---|---|---|---|
| 4,588,184 | 5/1986 | Jeschke . | |
| 4,678,176 | 7/1987 | Roller | 271/94 |
| 4,696,465 | 9/1987 | Willi . | |
| 4,971,304 | 11/1990 | Lofthus | 271/227 |
| 5,094,442 | 3/1992 | Kamprath et al. | 271/236 X |
| 5,219,159 | 6/1993 | Malachowski et al. | 271/228 |
| 5,232,213 | 8/1993 | Parsons et al. | 271/95 |
| 5,234,208 | 8/1993 | Bandura et al. | 271/228 X |

FOREIGN PATENT DOCUMENTS

| | | | |
|---|---|---|---|
| 3311196 | 10/1984 | Germany . | |
| 3442135 | 5/1986 | Germany . | |
| 9110473 | 1/1992 | Germany . | |
| 4035907 | 5/1992 | Germany . | |
| 4040831 | 6/1992 | Germany . | |
| 96246 | 5/1987 | Japan | 271/227 |
| 62-186839 | 11/1987 | Japan . | |
| 3267244 | 11/1991 | Japan . | |
| 2250506 | 6/1992 | United Kingdom . | |

OTHER PUBLICATIONS

"5000–pixel CCD Linear Sensor (B/W)", SONY, pp. 903–906.

*Primary Examiner*—William E. Terrell
*Assistant Examiner*—Tamara Kelly
*Attorney, Agent, or Firm*—Herbert L. Lerner; Laurence A. Greenberg

[57] ABSTRACT

A sheet feeder for a sheet-fed printing machine having a cylinder with a gripper system, movable suction conveyors for separating individual sheets from a sheet pile, the suction conveyors being disposed adjacent one another in a sheet-conveying direction, and groups of revolving adjustable conveying elements for aligning the sheets on a drive side and on an operating side of the printing machine in association with the suction conveyors and cooperating therewith for feeding the sheets to the gripper system of the cylinder of the printing machine, includes a drive system for driving the groups of conveying elements independently of one another and with varied speed so as to align the sheets on both of the sides of the printing machine, and a device disposed at locations of the revolving conveying elements for querying the sheet edges and for generating, in accordance with a response to a respective query, an electric pulse for controlling the drive system; and a method of separating and aligning the sheets in the sheet feeder.

6 Claims, 5 Drawing Sheets

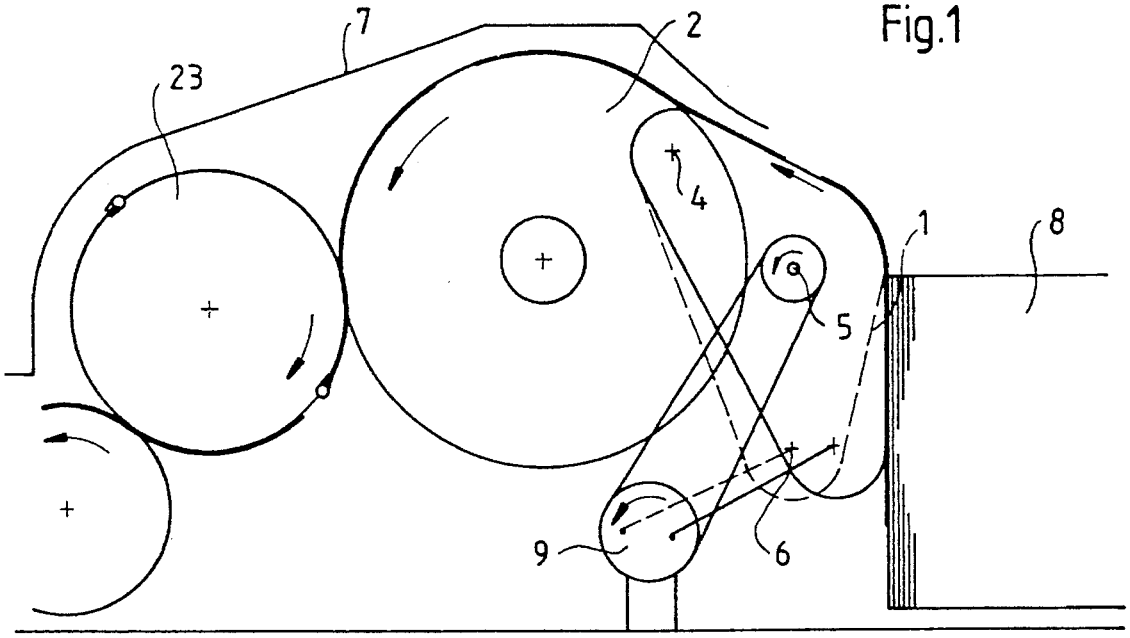
Fig.1
Fig.2
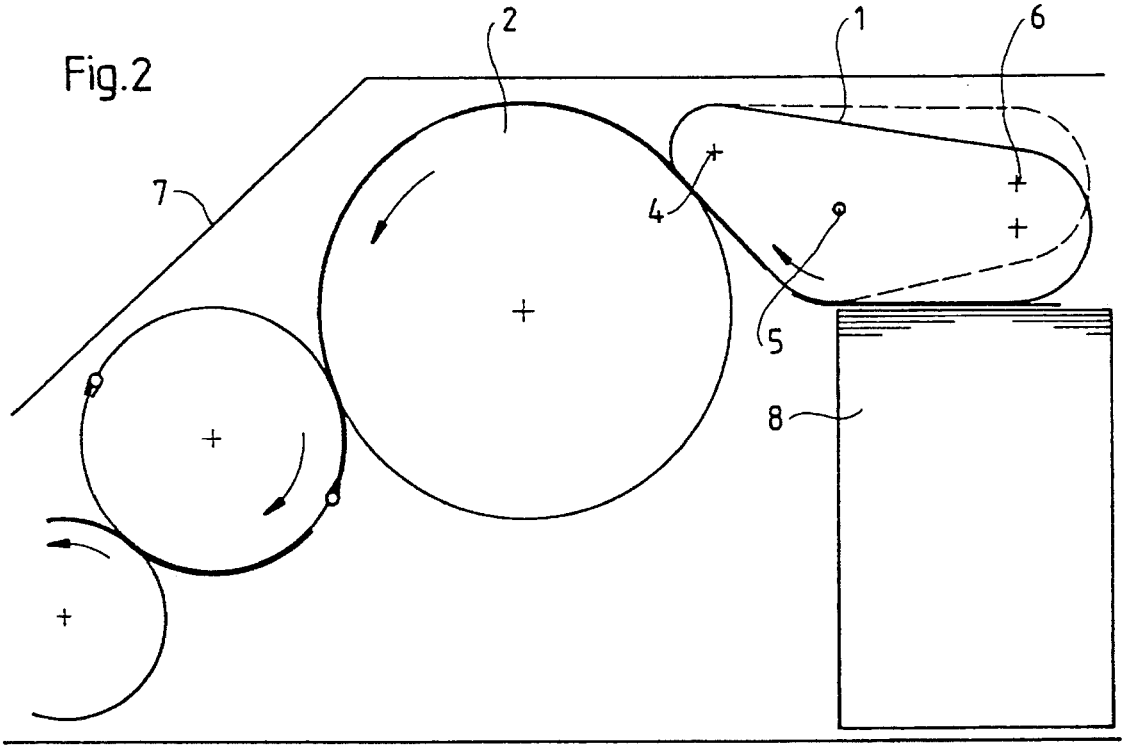

DEVICE AND METHOD FOR SEPARATING AND ALIGNING SHEETS IN A SHEET FEEDER OF A PRINTING MACHINE

The invention relates to a device and method for separating and aligning sheets in a sheet feeder of a sheet-fed printing machine, more particularly, having a cylinder with a gripper system, the device including movable suction conveyors for separating individual sheets from a sheet pile, the suction conveyors being disposed adjacent one another in a sheet-conveying direction, and revolving adjustable conveying means for aligning the sheets on a drive side and on an operating side of the printing machine in association with the suction conveyors and cooperating therewith for feeding the sheets to the gripper system of the cylinder of the printing machine.

Such a sheet feeder has become known heretofore from published German Patent Document 40 35 907 C1 wherein sheets lifted by a suction lifter from a sheet pile run through a device in sequence which aligns the sheets at the leading edge thereof against revolving front lays and against adjustable side stops, and feeds them to a gripper system of an impression cylinder. This heretofore known device is located between a suction-head sheet feeder of conventional construction and the first printing unit of a printing machine. In this heretofore known device, the sheets fed from the suction head by conveyor tapes are gripped by rollers revolving on shafts and arranged so as to be laterally displaceable in accordance with the printing-machine cycle, and thereby align the sheets against the side stops and, simultaneously, an alignment of the leading edge of the sheets against front lays revolving on tapes occurs due to the difference between the conveyor tapes, on the one hand, and the rollers, on the other hand. The alignment of the sheets is effected consequently by displacing the sheets against leading edge stops and side edge stops, so that trouble-free operation may be expected only when relatively stiff printing material is used, and an increased danger of sheet damage exists. All of the elements for sheet alignment are mechanical and are moreover mechanically moved, so that, at high printing speeds, inertial forces prevent an exact alignment, and premature wear of the components occurs. Mechanically displaced components also result in an increased, yet undesired noise development, and are often reachable only with great difficulty in relatively tight construction spaces.

Stream feeders have become known from published German Patent Document 34 42 135 A1 wherein, in an upper region of a feeder table, a transport system for conveying sheets offset in a stream-type or imbricated manner is provided. Associated therewith on the feeder table of the alignment region are a diagonal drive, side lays and front alignment lays for the leading edges revolving in the sheet-conveying direction. An accelerating device cooperates with the diagonal drive and accelerates the sheets to the revolving speed of the impression cylinder. At conveyor means following the diagonal drive, front lays are provided. With this heretofore known device, as well, the alignment of the sheets is thus effected by mechanical elements moving the sheets against stops.

Stream feeders for flowing engagement of sheets stream-fed on a feeder table with a rotating aligning cylinder, whereon initially the leading-edge alignment against front lays and, thereafter, a side edge alignment against side lays occur have become known heretofore from published German Patent Document 33 11 196 C2. The latter alignment displacement of the sheets occurs, respectively, by suction strips arranged so as to be laterally displaceable in the alignment cylinder, the suction strips applying suction to the sheets and causing the side edge thereof to push against one or more of the side or lateral stops.

Suction rollers for transporting sheets in a sheet feeder of a printing machine have become known heretofore, for example, from the published Japanese Patent Document Sho 62-186839 and other patent documents.

Also, German Gebrauchsmuster (Petty Patent) 91 10 473 discloses a sheet feeder for mainly vertical sheets arranged in a sheet pile, wherein several mutually adjacent endlessly revolving conveyor tapes operating by friction are provided. They have a straight separating section extending slightly inclined to the front surface of the sheet pile, and a conveyor section connected thereto after a deflection, by means of which a respectively following sheet is pushed under the respectively preceding sheet, thereby forming an imbricated or fish scale-like relationship therebetween.

In contrast therewith, it is an object of the invention to provide a sheet feeder of the general type described in the introduction hereto, wherein alignment of sheets is effected, after separation thereof individually, on the travel path thereof through the printing machine without any stops against which the leading edge of the sheets and the side edges of the sheet are to abut and without stopping the sheet at any time.

With the foregoing and other objects in view, there is provided, in accordance with the invention, in a sheet feeder for a sheet-fed printing machine having a cylinder with a gripper system, movable suction conveyors for separating individual sheets from a sheet pile, the suction conveyors being disposed adjacent one another in a sheet-conveying direction, and revolving adjustable conveying means for aligning the sheets on a drive side and on an operating side of the printing machine in association with the suction conveyors and cooperating therewith for feeding the sheets to the gripper system of the cylinder of the printing machine, including drive means for driving the conveying means independently of one another and with varied speed so as to align the sheets on both of the sides of the printing machine, and means disposed at locations of the revolving conveying means for querying the sheet edges and for generating, in accordance with a response to a respective query, an electric pulse for controlling the drive means.

The foregoing features of the invention permit an exact sheet alignment during movement of the sheet on its path of conveyance through the printing machine from the separation thereof individually when accepted from the sheet pile until the transfer thereof to the first printing unit without any stopping of the sheet or any pushing of the sheet against any fixed stop. The sheets, after acceptance thereof from the sheet pile and until the intake into the first printing unit, are accelerated to the speed of the printing machine without any intermediate stop or delay and, accordingly, optimally aligned. Especially thin paper are thereby able to be aligned exactly without any trouble even at high printing-machine speeds. Sheet acceptance may be effected either horizontally from a sheet pile formed of sheets lying flatly on top of one another or vertically at a side of a sheet pile formed of sheets lying with a side edge thereof on a pile table or similarly lying sheets.

In accordance with another feature of the invention, the drive means include separate drives for the suction conveyors for separating individual sheets, the separate drives being disposed, respectively at each of the drive and operating sides of the printing machine, and wherein the revolving conveying means include respective groups of conveying elements located at each of the drive and the operating sides of the printing machine, each of the separate drives, respectively, being controllable by the electric impulse from a control circuit for controlling the respective group of conveying elements at the same machine side at which the respective separate drive is located.

A coarse alignment of the sheets is thus afforded on the suction conveyors effecting the sheet acceptance from the sheet pile, and a fine alignment of the sheets on the revolving conveying means associated therewith, the control circuit for controlling the drives of the conveying means, on the one hand, providing the control pulses for the coarse alignment of the sheets by the suction conveyors.

In accordance with a further feature of the invention, the suction conveyors are formed as revolving suction tapes on both of the sides of the printing machine, and respective shafts are mounted on both of the machine sides swivelably independent of one another and perpendicularly to respective planes wherein said suction tapes revolve. The suction tapes on both sides of the printing machine which are driven with speeds deviating from one another and also independently of one another are thus swivelable about the respective shafts so that a sheet alignment in the direction of conveyance of the sheets and transversely thereto may be performed.

In accordance with an added feature of the invention, the revolving conveying means comprise a suction roller formed of a plurality of suction discs, and the drive means for the conveying means comprise separate drives therefor controllable independently of one another and located, respectively on each of the sides of the printing machine.

In accordance with an additional feature of the invention, the drive and operating sides are divided by a center line of the printing machine, and respective groups of the suction discs are disposed on the sides at an angle diverging from the center line in the sheet-conveying direction.

In accordance with yet another feature of the invention, the suction conveyors are formed as revolving suction tapes, at least one of which is located at each of the drive and operating sides of the printing machine, the revolving conveying means comprise a suction roller formed of groups of suction discs, respectively, located at each of the sides, and the drive means comprise a respective common drive located on each of the printing-machine sides for driving the respective at least one suction tape and the respective group of suction discs at the respective printing-machine side.

In accordance with yet another feature of the invention, the suction discs and a plurality of the suction tapes are located in pairs on each of the printing-machine sides and are driven in pairs by the respective common drive.

In accordance with yet a further feature of the invention, the suction conveyors are formed as revolving suction tapes having a respective rectilinear sheet-acceptance region, the suction tapes being swivelable in common about a horizontal axis so that the rectilinear sheet-acceptance regions thereof engage a respective topmost sheet of a sheet pile.

In accordance with yet an added feature of the invention, the suction tapes being guided over three deflecting rollers disposed in a triangular configuration, as viewed from respective ends thereof, the deflecting roller defining the apex of the triangular configuration being directed towards an edge of the sheet pile, and one of the other rollers disposed at an end of the rectilinear sheet-acceptance region of the suction tapes being swivelable about a central axis of the deflecting roller defining the apex of the triangular configuration towards and away from the topmost sheet of the sheet pile.

Thus, as conveyance means for the further transport and for fine alignment of the sheet, a suction drum or cylinder formed of several suction discs is provided having individual drives on both sides of the printing machine which are controllable independently of one another. The production of such a suction drum is relatively economical. The suction discs are controllable individually with individual or group drives both with respect to the conveying speed and also with respect to the revolving plane. As noted, the disposition of the suction discs on both sides of the center line of the printing machine at a diverging angle thereto and the capability of controlling the diverging angle during operation of the printing machine affords a particularly advantageous feature because the sheets transported on the suction discs of the suction roller or drum can be tautened or stretched from the center line of the printing machine towards the sides thereof, and this tautening or stretching is adjustable by varying the divergent angle, the varying of the diverging angle being possible on both sides of the printing machine independently of one another, if necessary or desirable.

In accordance with another aspect of the invention, there is provide a method of separating and aligning sheets in a sheet feeder of a printing machine wherein a leading edge and a side edge of a respective sheet are aligned on a conveyor path of the sheets through the sheet feeder, which comprises transporting to the printing machine, without stopping, a sheet which has been accelerated when accepted from a sheet pile, coarsely aligning the sheet in an initial stage, and finely aligning the sheet in a following stage, control pulses generated during the fine alignment being applied for controlling adjusting drives for effecting the coarse alignment.

In accordance with a concomitant aspect of the invention, there is provided a method of aligning sheets in a sheet feeder for a sheet-fed printing machine having a cylinder with a gripper system, and revolving adjustable conveying elements for aligning the sheets on a drive side and on an operating side of the printing machine and for feeding the sheets to the gripper system of the cylinder of the printing machine, which comprises controlling respective drives for the revolving adjustable conveying elements by varying the speeds thereof on both of the printing-machine sides.

Thus, in accordance the method of the invention, upon their acceptance from the sheet pile, the sheets are accelerated and transported without any intermediate stop to the printing unit of the printing machine and are, accordingly, coarsely aligned at the leading edge, as well as, at a side edge thereof. Then, they are finely aligned in a subsequent stage, control pulses generated for the fine alignment being used for controlling adjusting drives for the coarse alignment. With this method, the sheets are aligned by controlling the drives of the sheet-conveying elements independently of one another and, in fact, both with regard to the conveying speed, as well as, the conveying direction of the individual sheet-conveying elements on both sides of the printing machine.

The control of the position of the respective sheet on the suction tapes of the sheet acceptance device and on the suction discs of the suction roller can be effected advantageously by conventional CCD-lines. In addition, assurance must be provided that, for detecting the sheet edge, the latter is held in the focal plane of the CCD-line, for example, by applying blowing air which forces the sheet against the CCD-line.

Other features which are considered as characteristic for the invention are set forth in the appended claims.

Although the invention is illustrated and described herein as embodied in a device and method for separating and aligning sheets in a delivery of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic side elevational view of a delivery with a vertical sheet acceptance provided with the device according to the invention;

FIG. 2 is a view like that of FIG. 1 of a delivery with a horizontal sheet acceptance;

Figure 3:
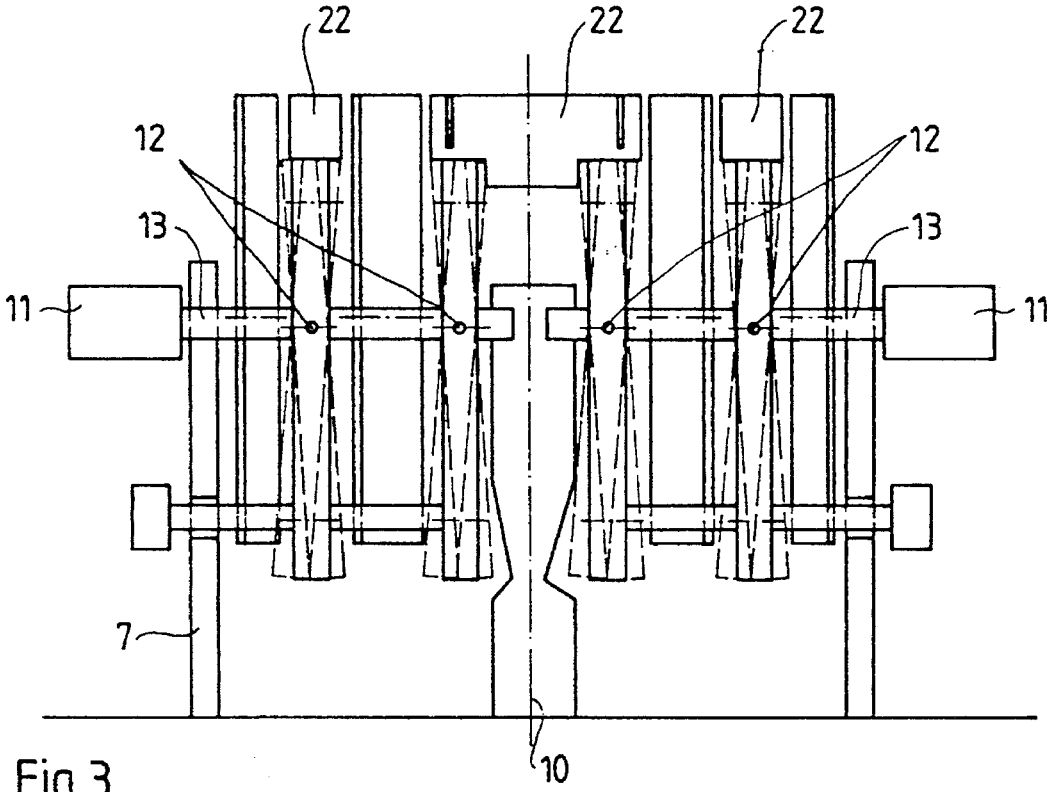
FIG. 3 is a front elevational view of FIG. 1 showing a revolving suction tape and a suction roller of the device according to the invention for effecting a vertical sheet acceptance.
Figure 4:
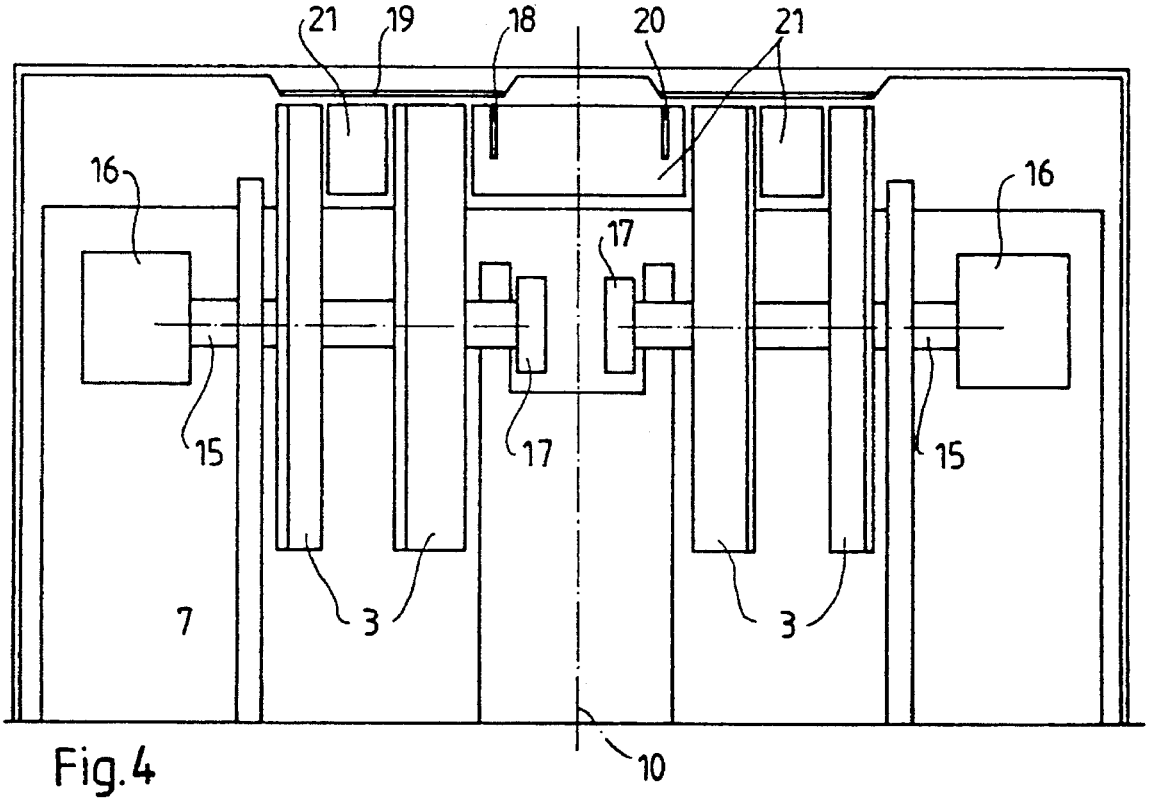
FIG. 4 is a view like that of FIG. 3 with the revolving suction tape and elements associated therewith omitted.

Referring now to the drawings and, first, particularly to FIGS. 1 and 2 thereof, there is shown therein a sheet feeder with a device for accepting or taking-up sheets either in a vertical direction (FIG. 1) or in a horizontal direction (FIG. 2), the device including mutually adjacent revolving suction tapes 1 and a suction roller 2 formed of several suction discs 3 (FIG. 4) connected therewith. The suction tapes 1 of the sheet acceptance device are guided over deflecting elements 4, 5 and 6 in a manner that a substantially rectilinearly extending suction-applying region is formed between the deflecting elements 5 and 6. The deflecting element 6 is movably mounted in the frame 7 of the printing machine and is provided with a drive, so that the suction tapes 1 with the rectilinear suction-applying region thereof are swivelable periodically, in accordance with the operating cycle of the printing machine, towards and back from the foremost and uppermost sheets, respectively, in the sheet pile 8. In FIG. 1, a motorized eccentric drive 9, for example, is shown to which the deflection element 6 is connected via a suitable linkage. In FIGS. 1 and 2, the suction tapes 1 are represented in solid lines in the forwardly swiveled position thereof, and in broken lines in the swiveled-back position thereof. In FIG. 3, the suction tapes 1 are shown provided with separate drive motors 11 on both sides of the center-line 10 of the printing machine. The suction tapes 1 are mounted by the deflecting element 5 thereof on a drive shaft 13 about an axis 12 disposed perpendicularly to the axis of this deflecting element 5 and are therefore swivelable about this swivel axis 12 in the region represented in FIG. 3 by broken lines. The swiveling action is realized by means of a universal joint (force-lock by a tongue-and-groove joint or force-lock hinged externally), a flexible coupling or a swivelable needle bearing. In this regard, it is noted that a force-locking connection is one which connects two elements together by force external to the elements, as opposed to a form-locking connection which is provided by the shapes of the elements themselves. For performing the swiveling movement, the deflection elements 6 on each side of the printing machine are connected to an adjusting drive by which the suction tapes 1 are moved about the swivel axis 12 thereof. As shown in FIG. 4, the suction discs 3 of the suction roller 2 are mounted on a separate shaft 15 in the machine frame 7 on each machine side on both sides of the center line 10 of the printing machine and, respectively, connected to their own drive motor 16. Both shafts 15 are mounted so as to be axially displaceable in the machine frame 7, and each shaft 15 is connected to a separate adjusting drive or servomotor 17 by which the suction discs 3 are axially displaceable on each machine side.

The control of the position of the sheet **8*a* on the suction roller 2 is effected by charge coupled device or CCD-lines 18, 19 and 20. The edge of the sheet is detected as a brightness difference and thus represents a position declaration. The cycle frequency to be selected is so high that, from one to the next query, even at maximum printing speed, at most, the maximum resolution of the CCD-line occurs. The CCD-lines 18, 19 and 20 are mounted on an attachment 21, the shape of which is contingent upon the shape of the suction roller 2**. Assurance is provided thereby that the leading edge of the sheet is drawn along the CCD-line.

Figure 5:
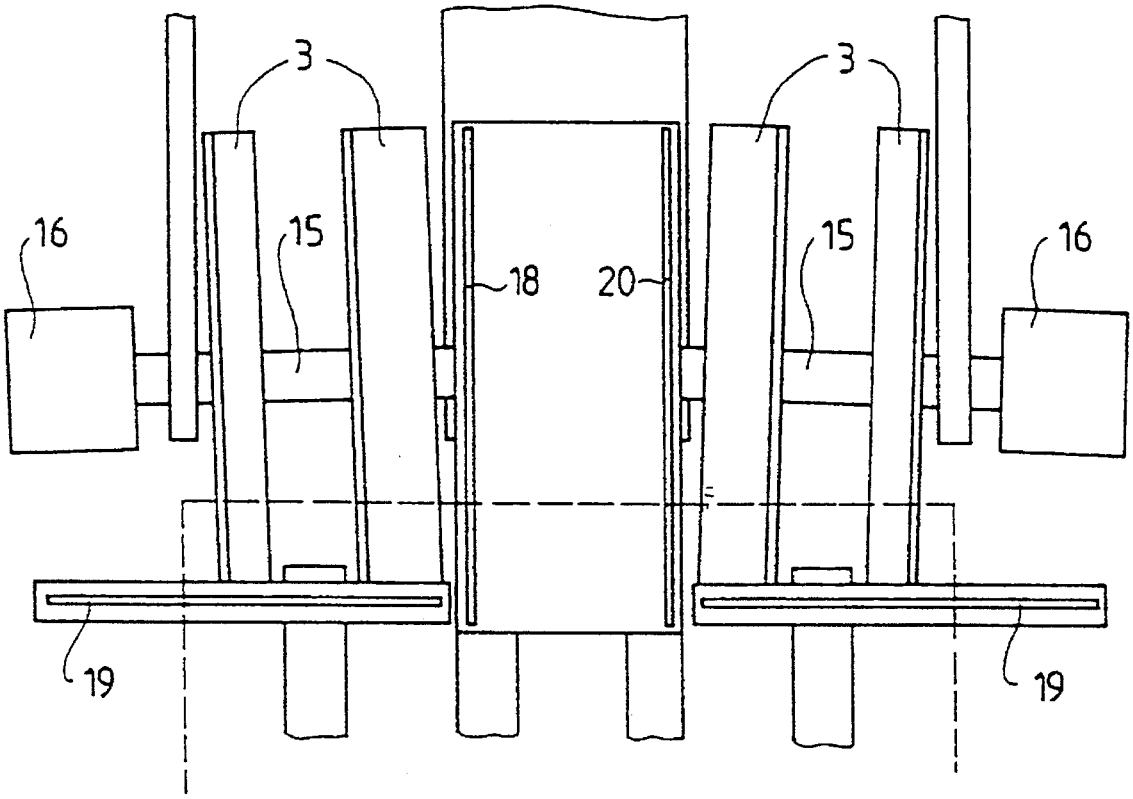
FIG. 5 is a top plan view of FIG. 4.

From the view in FIG. 5, it is apparent that the suction discs 3 are advantageously arranged on the shafts 15 at a diverging angle to the center line 10 of the printing machine, on both sides thereof.

At the start-up of the printing machine, the rectilinear suction-applying region of the suction tapes 1 is swiveled by the eccentric drive 9 against the uppermost sheet on the sheet pile 8. In the operating or work cycle of the printing machine, suction air is turned on so that the foremost and uppermost sheets, respectively, of the sheet pile 8 are subjected to suction through the suction tapes 1 and entrained. The drives of the suction tapes 1 at both sides of the center line 10 of the printing machine synchronously or asynchronously accelerate the the suction tapes 1. The first sheet is transferred to the suction roller 2 without any rough or coarse alignment. Every succeeding sheet, however, receives a coarse alignment. The swivelable part of the suction tapes 1 then swivels away from the pile 8 so that the following sheet is not subjected to suction without control. The leading edge of the sheet is guided by one or more guide plates 22 from the suction tapes 1 to the suction roller 2. After acceptance of the sheet **8*a* by the suction roller 2, the suction air in the suction tapes 1 is shut off, so that the swivelable region of the suction tapes 1 can be returned again to the uppermost sheet in the pile. In this regard, the speed of the suction tapes 1 is slowed and, if necessary or desirable, the suction tapes 1 come to a stop, altogether, before the suction air for applying suction to the next sheet is again turned on. The first query of the leading and side edges of the first sheet furnishes correction values for the coarse alignment of the second and every following sheet. For the coarse alignment of an early sheet, the drives of both groups on each side of the center line 10 of the printing machine are synchronously slowed during the sheet transport. Alternatively, the suction tapes 1** can also be braked mechanically or the drive speeds on both machine sides reduced synchronously. For the coarse alignment of a late sheet, the drives of the suction-tape groups on both machine sides are correspondingly accelerated synchronously during the sheet transport.

The coarse alignment of an out-of-square sheet is effected by asynchronously braking and, during the sheet transport, accelerating, respectively, the drive of the suction-tape groups on both sides of the printing machine. In this regard, the oblique position of the leading edge of the sheet produces control pulses for the drive of the suction tapes 1 on both of the machine sides.

For the coarse alignment of the side edge of the sheet in a direction towards the operating side of the printing machine, all of the suction tapes 1 are swiveled counter-clockwise about the axes 12, starting from a front elevational view of the suction tapes 1. For the coarse alignment of the side edge of the sheet in a direction towards the drive side, a clockwise swiveling of the suction tapes 1 about the axes 12 occurs analogously. For stretching the leading edge of the sheet, the group of the drive side is swiveled clockwise so as to perform the stretching to the operating side, whereby the group at the operating side is not changed in the drive. Conversely, a stretching occurs in the opposite direction. In this regard, it is recommended to apply an increased suction power to the unchanged drive group in order to stabilize the side edge of the sheet.

The instant the suction discs 3 of the suction roller 2 have fixed the sheet 8*a*, a first query from the sheet leading and side edges over the CCD-lines 18, 19 and 20 occurs. This query leads to a first drive correction and, accordingly, to a first correction of the sheet edges on the suction roller 2. Simultaneously, the query data are submitted to the drives of the suction tapes 1 of the sheet acceptance device so as to induce or enable the coarse alignment of the next sheet. The first query also decides whether it is possible to correct the sheet 8*a* until its transfer to the first reversing cylinder 23 of the printing unit. If this is not possible, the suction roller 2 and the suction tapes 1 are stopped. Should a single query be insufficient, the sheet 8*a* may repeatedly be interrogated at predetermined intervals or spaced locations on the way to the reversing cylinder 23 and adjusted, so that the sheet has reached the desired end position thereof at its transfer to the gripper system of the reversing cylinder 23.

A fine alignment of an early sheet is effected by synchronously slowing the drive of the two suction-roller groups on each machine side with respect to the reversing cylinder 23. This can be controlled alternatively by mechanical braking and possibly also via an adjusting drive. For fine alignment of a late sheet, the drives of both of the suction-roller groups on each machine side is synchronously accelerated with respect to the reversing cylinder 23. This can also be effected by mechanical acceleration, and possibly via a controllable free-wheeling system. For fine alignment of an oblique sheet, the drives of both suction-roller groups are asynchronously braked or accelerated depending upon the oblique position of the sheet. The fine alignment of the side edges of the sheet 8*a* is effected by axially displacing, by means of the adjusting drives or servomotors 17, the shafts 15 whereon the suction discs 3 are arranged.

Figure 6:
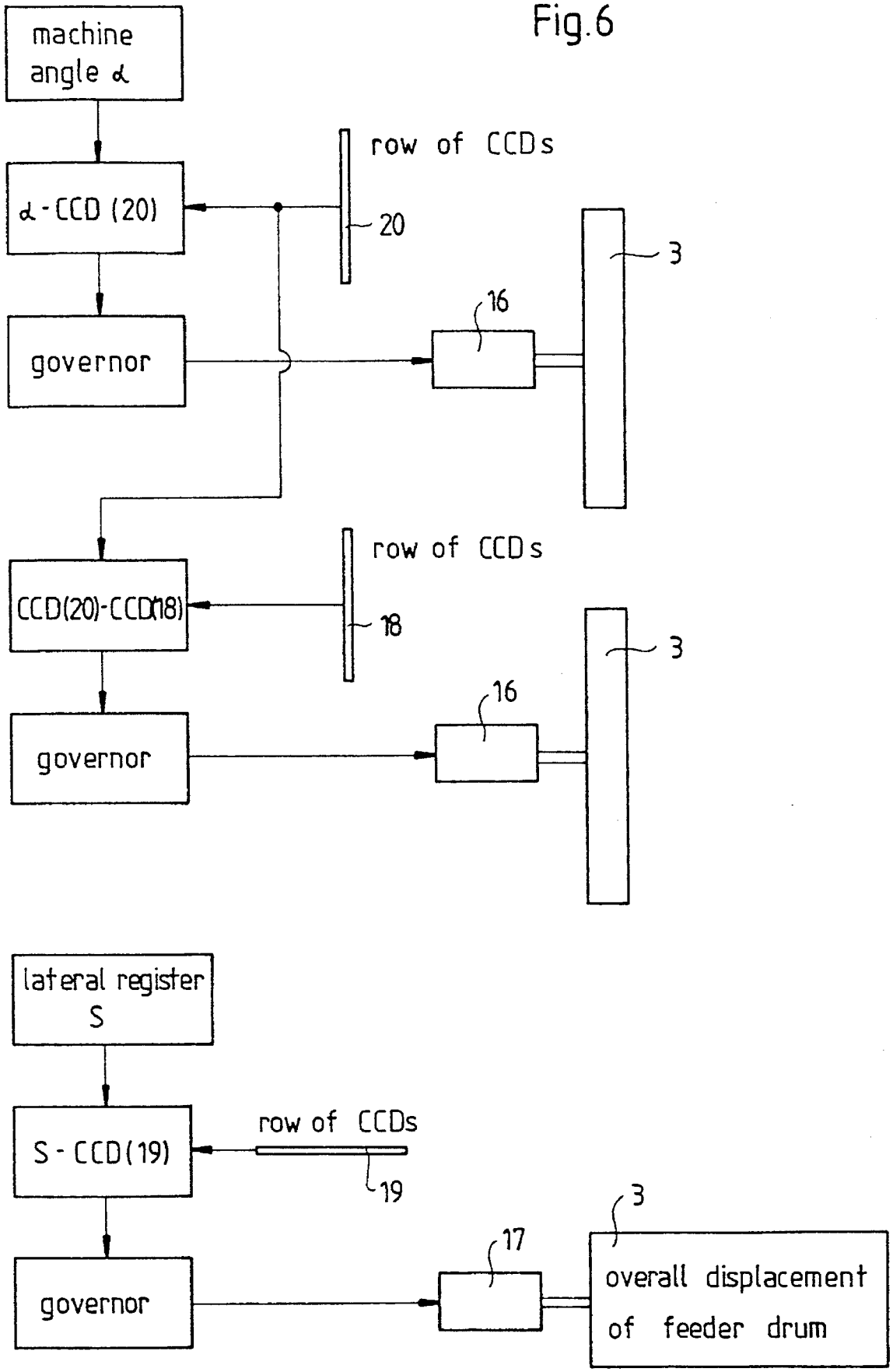
FIG. 6 is a block diagram representing the drive control and adjustment of the sheet-conveying elements in accordance with the invention.

In the aforedescribed manner, the separation or singling and the alignment of sheets on the transport path thereof through the sheet feeder is effected without any intervening or intermediate stop and delay, respectively. After the acceptance of the sheets from the sheet pile 8, they are accelerated once and are coarsely aligned in a first stage by the suction tapes 1 of the sheet acceptance device and, in a succeeding stage, are finely aligned by the suction discs 3 of the suction roller 2, so that they reach the gripper system of the reversing cylinder 23 in an optimal position. In the course thereof, the control pulses of the fine alignment act as control pulses for the adjusting drive for coarse alignment on the suction tapes 1 of the sheet acceptance device. An exemplary control scheme or block diagram explaining the operation is presented in FIG. 6.

Thus, in accordance with an angular setting $\alpha$ of the printing machine, the leading edge of the printing sheet must lie on the CCD-line 20. If there is no agreement or correlation, by regulating the drive motor 16, the suction discs 3 are suitably decelerated and accelerated, respectively. A second CCD-line 18, dependent upon the CCD-line 20, controls whether the leading edge assumes the same position at the right-hand and the left-hand side, i.e., whether parallelism of the sheet to the cylinders is provided. If no parallelism exists, a correction of the sheet position may be performed due to the fact that, on the drive and the operating sides, respectively, a separate drive motor 16 for the respective suction disc 3 and suction-disc group is provided. To perform the correction, a signal representing the difference between the positions on the drive and the operating sides is fed to a governor which effects an acceleration and deceleration, respectively, of the suction-disc drive motor 16. The respective third and fourth CCD-line 19 controls the side register with respect to an absolute value which is size or format-dependent and manually set by the pressman. A correction of the side register is performed by having the servomotors 17 effect a parallel displacement of the shafts 15 of the suction discs 3.

Figure 7:
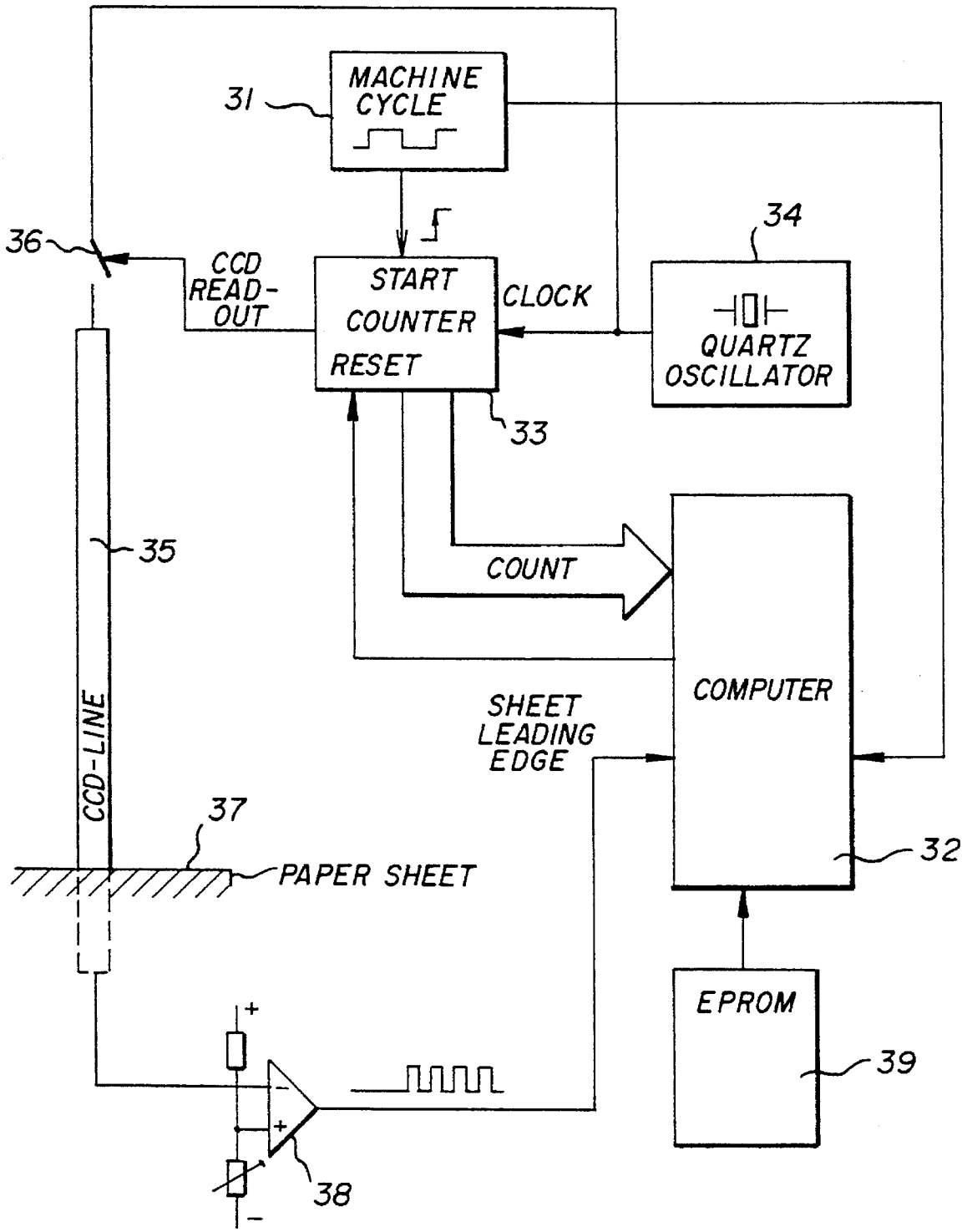
FIG. 7 is a circuit diagram showing in detail the components and the connections thereof for utilizing a CCD-line (Charge Coupled Device) to control the leading edge of a paper sheet.

It is apparent from the detailed circuit diagram of FIG. 7 that a printing-machine cycle 31 generated by rotary motion therein and fed to a computer 32 provides information thereto regarding the actual angular position of the printing machine. A counter 33 is started by the machine cycle 31 and counts pulses transmitted thereto from a quartz oscillator 34. Upon the starting of the counter 33, a read-out of a CCD-line 35 is commenced due to a closing of a switch 36. The CCD-line 35 is partly covered by a forward movement, in a direction from the bottom towards the top of FIG. 7, by a paper sheet 37, due to which the individual CCD-elements of the line 35 receive varying brightness signals. An output signal of the CCD-line 35 is digitalized by a conventional threshold-value switch 38. The first pulse representing so-to-speak the leading edge of the sheet 37 is fed to the computer 32. With the receipt of the sheet leading-edge signal from the threshold-value switch 38, the computer 32 queries the count of the counter 33 whereby a response or statement regarding the position of the paper sheet 37 is possible. Because the printing-machine speed, i.e., the machine cycle 31, and the frequency of the quartz oscillator 34 do not have any fixed relationship with one another, a correction of the paper-sheet position based upon the printing-machine speed is necessary. The correction is made in accordance with a correction table deposited or stored in an EPROM 39 in a conventional manner.

We claim:

1. In a sheet feeder for a sheet-fed printing machine having a cylinder with a gripper system, movable suction conveyors for separating individual sheets from a sheet pile, the suction conveyors being disposed adjacent one another in a sheet-conveying direction, and revolving adjustable conveying means for aligning the sheets on a drive side and on an operating side of the printing machine in association with the suction conveyors and cooperating therewith for feeding the sheets to the gripper system of the cylinder of the printing machine, comprising drive means for driving the conveying means independently of one another and with varied speed so as to align the sheets on both of the sides of the printing machine, means disposed at locations of the revolving conveying means for querying the sheet edges and for generating, in accordance with a response to a respective query, an electric pulse for controlling said drive means, and side register correction means for effecting a parallel diplacement of the revolving adjustable conveying means.

2. Sheet feeder according to claim 1, wherein said suction conveyors are formed as revolving suction tapes on both of the sides of the printing machine, and including respective shafts mounted on both of the machine sides swivelably independent of one another and perpendicularly to respective planes wherein said suction tapes revolve.

3. Sheet feeder according to claim 1, wherein said suction conveyors are formed as revolving suction tapes having a respective rectilinear sheet-acceptance region, said suction tapes being swivelable in common about a horizontal axis so that said rectilinear sheet-acceptance regions thereof engage a respective topmost sheet of a sheet pile.

4. In a sheet feeder for a sheet-fed printing machine having a cylinder with a gripper system, movable suction conveyors for separating individual sheets from a sheet pile, the suction conveyors being disposed adjacent one another in a sheet-conveying direction, and revolving adjustable conveying means for aligning the sheets on a drive side and on an operating side of the printing machine in association with the suction conveyors and cooperating therewith for feeding the sheets to the gripper system of the cylinder of the printing machine, comprising drive means for driving the conveying means independently of one another and with varied speed so as to align the sheets on both of the sides of the printing machine, and means disposed at locations of the revolving conveying means for querying the sheet edges and for generating, in accordance with a response to a respective query, an electric pulse for controlling said drive means, wherein said revolving conveying means comprise a suction roller formed of a plurality of suction discs, and wherein said drive means for said conveying means comprise separate drives therefor controllable independently of one another and located, respectively on each of the sides of the printing machine.

5. Sheet feeder according to claim 4, wherein the drive and operating sides are divided by a center line of the printing machine, and respective groups of said suction discs are disposed on the sides at an angle diverging from said center line in the sheet-conveying direction.

6. Method of separating and aligning sheets in a sheet feeder of a printing machine wherein a leading edge and a side edge of a respective sheet are aligned on a conveyor path of the sheets through the sheet feeder, which comprises transporting to the printing machine, without stopping, a sheet which has been accelerated when accepted from a sheet pile, coarsely aligning the sheet in an initial stage, and finely aligning the sheet in a following stage, control pulses generated during the fine alignment being applied for controlling adjusting drives for effecting the coarse alignment of a subsequent sheet.

* * * * *